US005397453A

United States Patent [19]

Imori

[11] Patent Number: 5,397,453

[45] Date of Patent: Mar. 14, 1995

[54] SEMICONDUCTOR PRODUCT PLATING APPARATUS

[75] Inventor: Yoshihisa Imori, Yokohama, Japan

[73] Assignee: Kabushiki Kaisha Toshiba, Kawasaki, Japan

[21] Appl. No.: 73,504

[22] Filed: Jun. 9, 1993

[30] Foreign Application Priority Data

Jun. 10, 1992 [JP] Japan ..... 4-150799
Jun. 10, 1992 [JP] Japan ..... 4-150800

[51] Int. Cl.[6] ..... C25D 5/02

[52] U.S. Cl. ..... 205/123; 205/128; 205/133

[58] Field of Search ..... 204/224 R, 242, 206, 204/275, 225; 205/123, 133, 128

[56] References Cited

U.S. PATENT DOCUMENTS 3,723,283 3/1973 Johnson ..... 204/206

*Primary Examiner*—John Niebling
*Assistant Examiner*—Brendan Mee
*Attorney, Agent, or Firm*—Finnegan, Henderson, Farabow, Garrett & Dunner

[57] ABSTRACT

A semiconductor product plating apparatus includes housings having a first mask portion for masking both the surfaces of a resin package of a semiconductor device and a second mask portion for masking the peripheral portion of a lead frame, when clamping a semiconductor product from both surface sides of the lead frame, and hollow portions surrounding outer leads between the semiconductor device and the peripheral portion of the lead frame. Electrolytic solution supply slits and electrolytic solution drainage slits are formed in the housings so as to communicate with the hollow portions. The apparatus also includes electrodes formed on portions of the inner wall surfaces of the hollow portions. The first mask portion has a tapered side surface which widens toward the end. The electrolytic solution supply slits have opening portions formed in a direction to cross the proximal end portions of the outer leads and communicating with the side surface of the first mask portion.

8 Claims, 4 Drawing Sheets

SEMICONDUCTOR PRODUCT PLATING APPARATUS

BACKGROUND OF THE INVENTION

1. Field of the Invention

The present invention relates to a plating apparatus for plating outer leads of resin-encapsulated semiconductor devices and, more particularly, to a jet plating apparatus for spraying an electrolytic solution onto outer leads.

2. Description of the Related Art

Generally, in the manufacture of resin-encapsulated semiconductor devices, exterior plating (plating for outer leads) is performed for molded (resin-encapsulated) semiconductor devices to protect the surfaces of outer leads and facilitate soldering in mounting.

A conventional exterior plating step for resin-encapsulated semiconductor devices adopts a method of dipping resin-encapsulated semiconductor devices in the form of a multiple lead frame hung on a rack into an electrolytic solution, or a method of performing plating for resin-encapsulated semiconductor devices in the form of either a multiple lead frame or parts separated therefrom by using a barrel.

Since the above methods require a long time for performing plating, i.e., a long plating time, it is necessary to increase the productivity by increasing the number of semiconductor devices that can be processed at one time (e.g., by performing the processing for several tens frames simultaneously).

Increasing the number of semiconductor devices that can be processed at one time, however, leads to degradation in quality of plating (e.g., variations in plated film thickness). In addition, since the size of a plating apparatus is increased, it becomes difficult to incorporate the exterior plating step into an assembly line, i.e., to realize an in-line system.

There is another known method in which silver plating (or gold plating) is performed on one surface of an island portion of a lead frame and one surface of a peripheral inner lead before resin encapsulation. In this method, as shown in FIG. 1, a portion except one surface of an island portion 51 of a lead frame and one surface of a peripheral inner lead 52 is masked with a mask portion 50, and a silver electrolytic solution (or a gold electrolytic solution) 54 is sprayed from a nozzle 53 of a jet plating apparatus toward the island portion 51, thereby performing plating. In this case, the silver electrolytic solution 54 sprayed from the nozzle 53 is drained through a drainage 55 formed around the nozzle 53.

Because the method requires only a short time for performing plating, it may be applicable to the exterior plating step for resin-encapsulated semiconductor devices.

If, however, the above conventional jet plating apparatus for performing plating on a flat surface, such as the surface of a lead frame, is used to perform plating for objects to be plated having uneven surfaces, such as those processed in the exterior plating step for resin-encapsulated semiconductor devices, no uniform plated film thickness can be obtained throughout the outer leads.

As described above, if the conventional jet plating apparatus is directly used in solder plating for outer leads of resin-encapsulated semiconductor devices, no satisfactorily high quality of plating can be obtained.

SUMMARY OF THE INVENTION

It is an object of the present invention to provide a semiconductor product plating apparatus capable of performing high-quality solder plating for outer leads of resin-encapsulated semiconductor devices on a multiple lead frame within a short time period.

A semiconductor product plating apparatus according to the present invention comprises: a first housing having a first mask portion projecting from a main body to mask one surface of a resin package of one of a plurality of resin-encapsulated semiconductor devices formed spaced apart from each other with a predetermined interval on a multiple lead frame in the longitudinal direction of the multiple lead frame and a second mask portion, projecting from the main body to surround the first mask portion, for masking one surface of a peripheral portion of the multiple lead frame; a second housing having a third mask portion projecting from a main body to mask the other surface of the resin package of one of the resin-encapsulated semiconductor devices and a fourth mask portion, projecting from the main body to surround the third mask portion, for masking the other surface of the peripheral portion of the multiple lead frame, the second housing being disposed to be movable closer to and away from the first housing; first and second electrolytic solution supply slits formed at the start end portion of the first mask portion of the first housing along both the side portions of the first mask portion; first and second electrolytic solution drainage slits formed at the start end portion of the second mask portion of the first housing along both the side portions of the second mask portion; third and fourth electrolytic solution supply slits formed at the start end portion of the third mask portion of the second housing along both the side portions of the third mask portion; third and fourth electrolytic solution drainage slits formed at the start end portion of the fourth mask portion of the second housing along both the side portions of the fourth mask portion; first and second electrodes arranged on the main body bottom portion of the first housing; third and fourth electrodes arranged on the main body bottom portion of the second housing; a power supply unit for applying a positive voltage to the electrodes and a negative voltage to outer leads; and an electrolytic solution supply unit for supplying an electrolytic solution to the first to fourth electrolytic solution supply slits from outside of the first and second housings.

When the semiconductor product is clamped from both surface sides by the hollow structure in performing plating, both the surfaces of the resin package of the semiconductor device and those of the peripheral portion of the multiple lead frame are masked. Subsequently, with the positive voltage being applied to the electrodes and the negative voltage to the outer leads, the electrolytic solution is sprayed from the electrolytic solution supply slits into the hollow portions defined by the first and second housings. As a result, the electrolytic solution flows between the electrodes and the outer leads and is drained outside the first and second housings through the electrolytic solution drainage slits. In the course of this processing, electroplating is performed on the surfaces of the outer leads within a short time period. In this case, spraying the electrolytic solution from both surface sides of the outer leads reduces the variation in plated film thickness between the two surfaces of each outer lead.

In addition, compared to the conventional method in which a whole semiconductor product is dipped in an electrolytic solution, although the number of semiconductor products that can be processed simultaneously is small, the plating unit is decreased in size to decrease the size of the overall plating apparatus. This facilitates a semiconductor device assembly line of an in-line type.

Another semiconductor product plating apparatus according to the present invention comprises: a first housing having a first mask portion projecting from a main body to mask one surface of a resin package of one of a plurality of resin-encapsulated semiconductor devices formed spaced apart from each other with a predetermined interval on a multiple lead frame in the longitudinal direction of the multiple lead frame and a second mask portion, projecting from the main body to surround the first mask portion, for masking one surface of a peripheral portion of the multiple lead frame; a second housing having a third mask portion projecting from a main body to mask the other surface of the resin package of one of the resin-encapsulated semiconductor devices and a fourth mask portion, projecting from the main body to surround the third mask portion, for masking the other surface of the peripheral portion of the multiple lead frame, the second housing being disposed to be movable closer to and away from the first housing; first and second electrolytic solution supply slits formed at the start end portion of the first mask portion of the first housing along both the side portions of the first mask portion; first and second electrolytic solution drainage slits formed at the start end portion of the second mask portion of the first housing along both the side portions of the second mask portion; third and fourth electrolytic solution supply slits formed at the start end portion of the third mask portion of the second housing along both the side portions of the third mask portion; third and fourth electrolytic solution drainage slits formed at the start end portion of the fourth mask portion of the second housing along both the side portions of the fourth mask portion; first and second electrodes arranged on the main body bottom portion of the first housing; third and fourth electrodes arranged on the main body bottom portion of the second housing; a power supply unit for applying a positive voltage to the electrodes and a negative voltage to the outer leads; and an electrolytic solution supply unit for supplying an electrolytic solution to the first to fourth electrolytic solution supply slits from outside the first and second housings, wherein the first mask portion has a tapered side surface which widens toward the end, the first to fourth electrolytic solution supply slits are formed in a direction in which they cross the end portions of the outer leads on the semiconductor device side, and the first to fourth electrolytic solution drainage slits are formed in a direction in which they cross the end portions of the outer leads on the lead frame side.

In the above semiconductor device plating apparatus according to the present invention, the electrolytic solution supply slits are formed in the direction in which they cross the proximal end portions of the outer leads of the semiconductor device and have the opening portions that communicate with the side surface of the first mask portion. This makes it possible to spray the electrolytic solution toward the proximal end portions of the outer leads along the tapered side surface of the first mask portion, allowing the electrolytic solution to flow in uniform contact with the surfaces of the outer leads. As a result, high-quality solder plating can be performed.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The embodiments of the present invention will be described in detail below with reference to the accompanying drawings.

Figure 1:
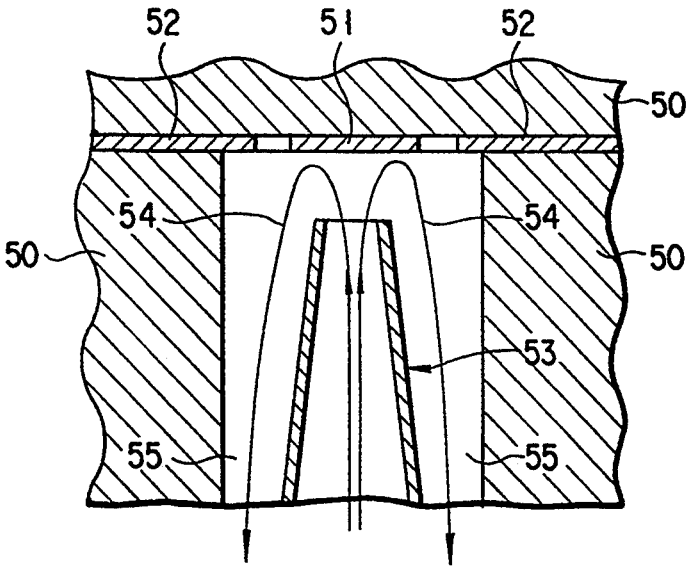
FIG. 1 is a sectional view showing a conventional jet plating apparatus which plates a metal on one surface of a lead frame and an inner lead of a semiconductor device.
Figure 2:
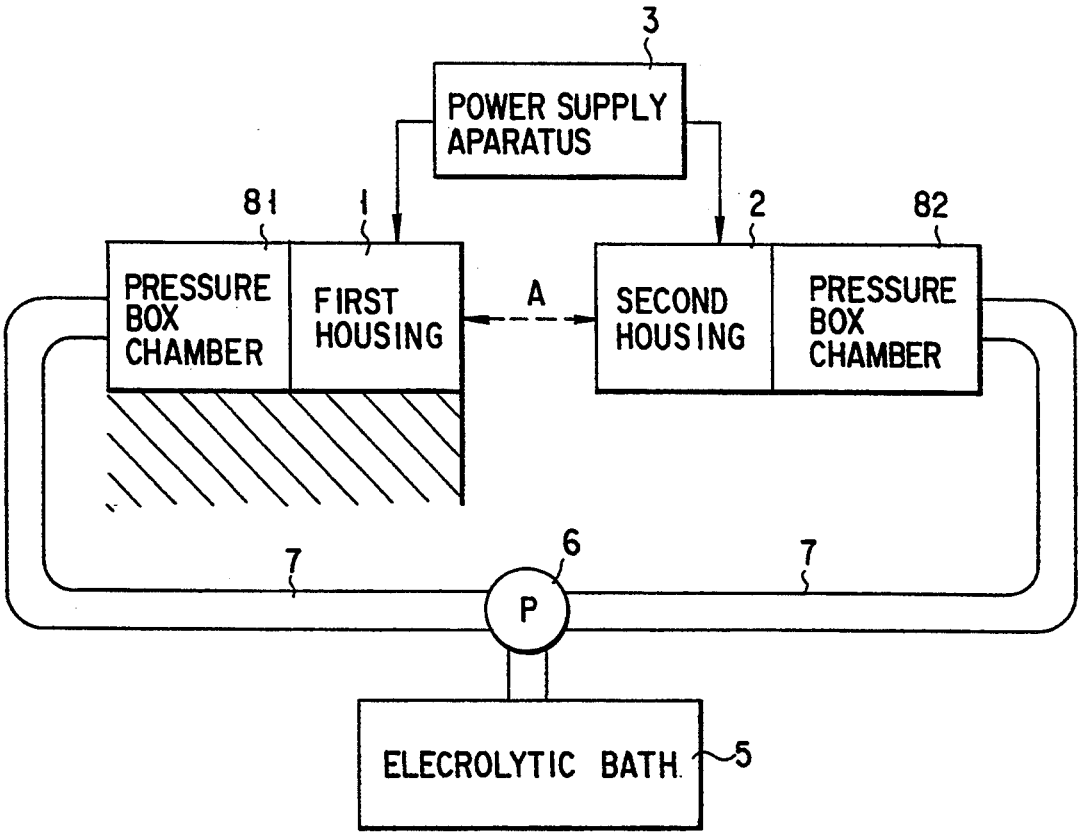
FIG. 2 is a schematical view of an entire construction of the jet plating apparatus of the present invention.

FIG. 2 schematically shows the arrangement of a sparger type jet plating apparatus used in a semiconductor device exterior plating step according to one embodiment of the present invention.

Referring to FIG. 2, reference numerals 1 and 2 denote first and second housings (to be described in detail later); 3, a power supply apparatus; 5, an electrolytic bath; 6, an electrolytic solution supply pump; 7, electrolytic solution supply pipes; and 81 and 82, pressures boxes.

Figure 3:
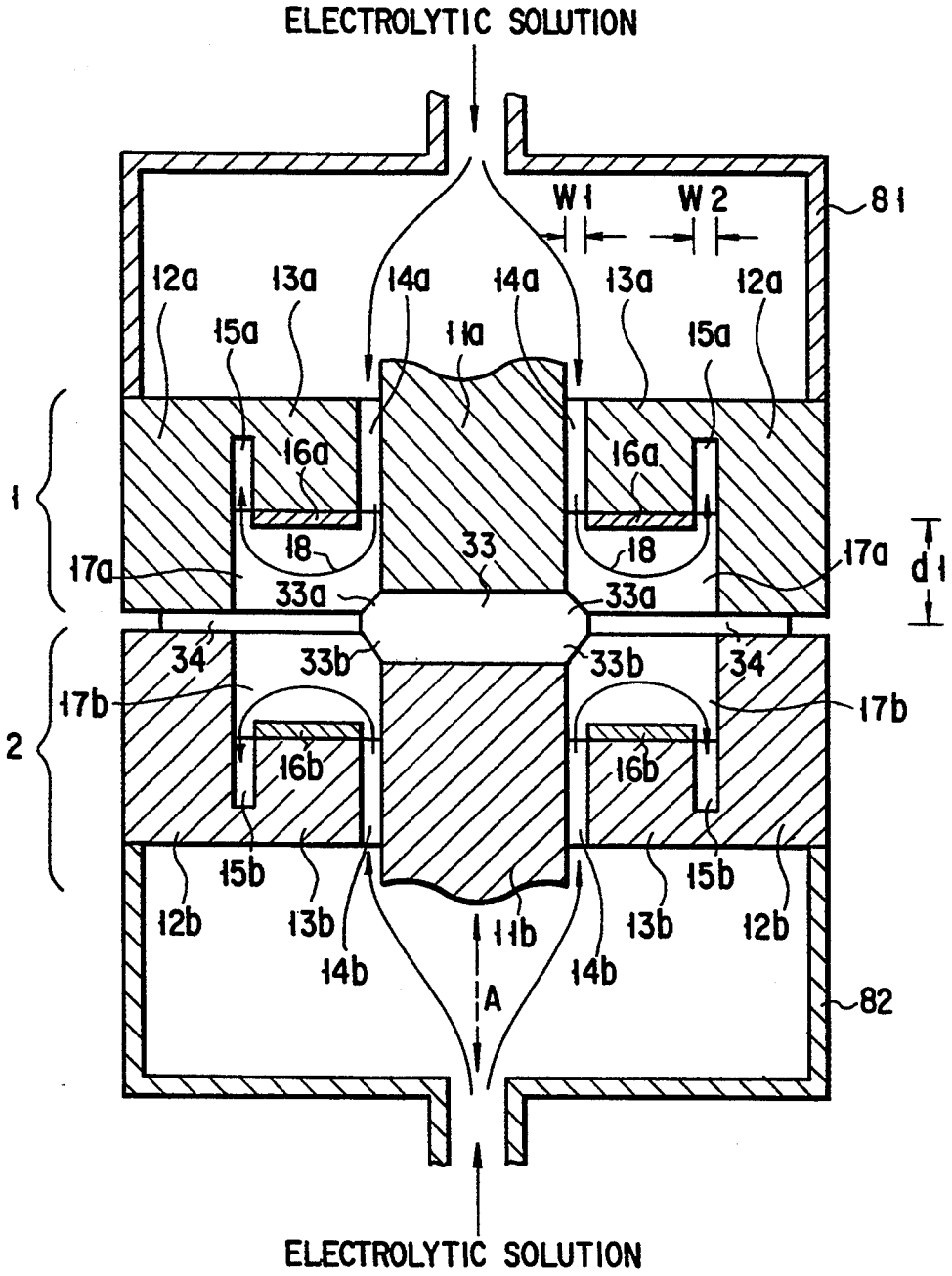
FIG. 3 is a sectional view of a principal part of the jet plating apparatus according to a first embodiment of the present invention.

FIG. 3 is a sectional view schematically showing the sectional structure when the plating apparatus shown in FIG. 2 performs plating.

Figure 4A:
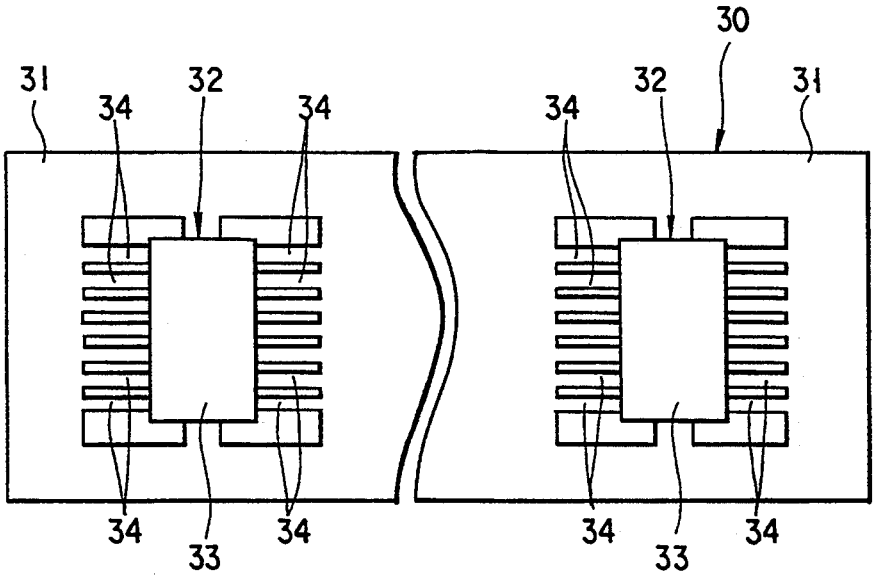
FIGS. 4A and 4B are a top plan view and a side elevation of a semiconductor product to be plated by using the jet plating apparatus of the present invention.
Figure 4B:
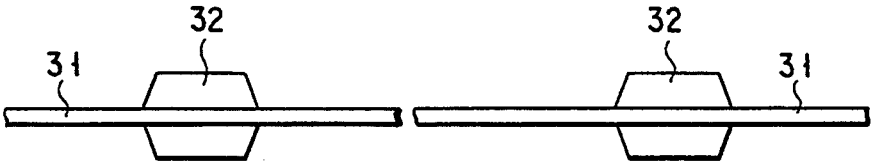

FIGS. 4A and 4B are a top plan view and a side elevation, respectively, showing a state in which a plurality of semiconductor devices as objects to be plated are mounted on a lead frame.

This semiconductor device 32 is of a resin-encapsulated type, and a plurality of these semiconductor devices 32 are formed spaced apart from each other with a predetermined interval in the longitudinal direction of a multiple lead frame 31. As shown in FIG. 3, the semiconductor device 32 is subjected to exterior plating while being clamped by mask portions 11 from both surface sides of a resin package 33. In this embodiment, the semiconductor device 32 is of a dual in-line type in which outer leads 34 project from both the side surfaces of the resin package 33.

Referring to FIGS. 2 and 3, the first housing 1 comprises a first projecting mask portion 11*a* for masking one surface of the resin package 33 of the semiconductor device and a second projecting mask portion 12*a* for masking one surface of the lead frame 31 around the outer leads 34. A housing portion 13*a* between the two mask portions 11*a* and 12*a* has an electrolytic solution supply slit 14*a* and an electrolytic solution drainage slit 15*a* (to be described later) which communicate with a recessed space defined by the first and second mask portions 11*a* and 12*a*. An electrode 16*a* is also formed on a portion of the surface of the lower inner wall (the surface that opposes the surfaces of the outer leads at a distance) of the housing portion 13*a*. An electrode terminal (not shown) is connected to the electrode 16 to apply a voltage from the outside of the first and second housings 1 and 2.

The second housing 2 has the same structure as the first housing 1 described above.

That is, the second housing 2 comprises a third projecting mask portion 11*b* for masking the other surface of the resin package 33 of the semiconductor device and a fourth projecting mask portion 12*b* for masking the other surface of the lead frame 31 around the outer leads 34. A housing portion 13*b* between the two mask portions 11*b* and 12*b* has an electrolytic solution supply slit 14*b* and an electrolytic solution drainage slit 15*b* which communicate with a recessed space defined by the third and fourth mask portions 11*b* and 12*b*. An electrode 16*b* is also formed on a portion of the surface of the upper inner wall (the surface that opposes the surfaces of the outer leads at a distance) of the housing portion 13*b*. An electrode terminal (not shown) is connected to the electrode 16*b* to apply a voltage from the outside of the first and second housings 1 and 2.

The second housing 2 is provided to be movable closer to and away from the first housing 1, as indicated by an arrow A in FIG. 3, so as to clamp the semiconductor device 32 from its both surface sides together with the first housing 1. When the second housing 2 moves closer to the first housing 1 to allow the mask portions 11*a*, 12*a*, 11*b*, and 12*b* to clamp from both surface sides the resin package 33 and the lead frame 32 around the outer leads 34, thereby holding the semiconductor device 32, both the surfaces of the resin package 33 and those of the lead frame 31 around the outer leads 34 are masked, and a hollow structure (cavity) having hollow portions 17*a* and 17*b* surrounding the outer leads 34 is formed. In this case, a distance d1 between the electrode surface and the outer leads 34 is, e.g., 10 mm.

Although the first and second housings 1 and 2 are formed in numbers corresponding to the number of the semiconductor devices 32 of a semiconductor product 30, they are represented by only one each of them.

In the first and second housings 1 and 2, the electrolytic solution supply slits 14*a* and 14*b* and the electrolytic solution drainage slits 15*a* and 15*b* are formed to communicate with the hollow portions 17*a* and 17*b*, respectively, that correspond to each semiconductor device 32. That is, the electrolytic solution supply slits 14*a* and 14*b* and the electrolytic solution drainage slits 15*a* and 15*b* communicate with the side surfaces of the first, second, third, and fourth masks, respectively, and are formed parallel to each other.

In this embodiment, the electrolytic solution supply slits 14*a* and 14*b* are so formed as to extend through the housing portions 13*a* and 13*b*, respectively, in a direction to cross the proximal end portions (or the distal end portions) of the outer leads 34 of the semiconductor device 32 when the semiconductor 30 is clamped from its both surface sides. The openings of the slits 14*a* and 14*b* have a length enough to cross the proximal end portions of the outer leads, and an opening width w1 of the slits 14*a* and 14*b* is, e.g., 2 mm.

The electrolytic solution drainage slits 15*a* and 15*b* are also formed in the housing portions 13*a* and 13*b*, respectively, in a direction to cross the distal end portions (or the proximal end portions) of the outer leads 34 of the semiconductor device 32. The electrolytic solution drainage slits 15*a* and 15*b* are formed parallel to the electrolytic solution supply slits 14*a* and 14*b*, respectively.

The power supply apparatus 3 applies a positive voltage to the electrodes 16*a* and 16*b* via the respective electrode terminals and also applies a negative voltage to the outer leads 34 from the end portion of the multiple lead frame 31.

An electrolytic solution supply unit is also provided to supply an electrolytic solution 18 at a predetermined pressure to the electrolytic solution supply slits 14*a* and 14*b* from the outside of the first and second housings 1 and 2.

As shown in FIG. 2, this electrolytic solution supply unit comprises the electrolytic bath 5, the electrolytic solution supply pump 6, a plurality of the electrolytic solution supply pipes 7, and the electrolytic solution supply pressure boxes 81 and 82 which are supplied with the electrolytic solution from the pipes 7. The interior of each of the pressure boxes 81 and 82 is divided into a plurality of sections in correspondence with a plurality of the pipes 7. The electrolytic solution is supplied from the sections (chambers) of the pressure boxes 81 and 82 to the hollow portions 17*a* and 17*b* corresponding to each semiconductor device 32. The pressure box 81 is formed integrally with the first housing 1, and the pressure box 82 is formed integrally with the second housing 2.

A width w2 of the opening portions of the electrolytic solution drainage slits 15*a* and 15*b* is equal to or smaller than the opening width w1 of the electrolytic solution supply slits 14*a* and 14*b*.

A practical example of plating performed for the semiconductor product 30 by using the above jet plating apparatus will be described in detail below.

Figure 5:
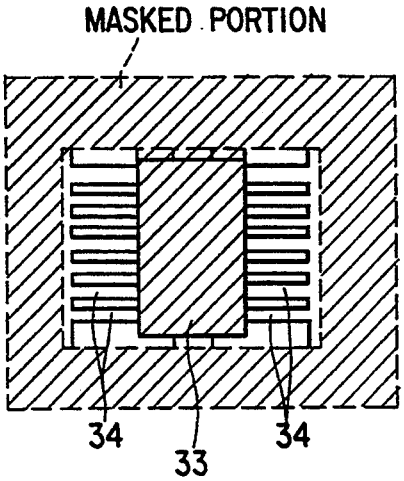
FIG. 5 is a top plan view of the semiconductor product showing a state that the semiconductor product is masked with the jet plating apparatus shown in FIG. 3.

FIG. 5 is a top plan view showing a state that the semiconductor product 30 is masked with the first and second housings 1 and 2 during plating, in which the masked portion is hatched.

When the semiconductor product 30 is clamped from both sides by the first and second housings 1 and 2 in performing plating, both the surfaces of the resin package 33 of the semiconductor device 32 and the lead frame 31 around the outer leads 34 are masked. With the positive voltage applied to the electrodes 16*a* and 16*b* and the negative voltage to the outer leads 34, the electrolytic solution 18 is sprayed from the slits 14*a* and 14*b* into the hollow portions 17*a* and 17*b*. The electrolytic solution 18 flows between the electrodes 16*a* and 16*b* and the outer leads 34 and drained outside the housings through the electrolytic solution drainage slits 15*a* and 15*b*. In the course of this processing, both the surfaces of each outer lead 34 are electroplated within a short time period. During the processing, the flow rate of the electrolytic solution is set to, e.g., 20 liters/min, and the current density of the electrolytic solution 18 flowing through the hollow portions 17*a* and 17*b* is controlled by the power supply apparatus 3.

According to the jet plating apparatus of the above embodiment, electroplating can be performed on both the surfaces of each outer lead 34 within a short time period by spraying the electrolytic solution 18 into the hollow portions 17*a* and 17*b*. In this case, since the electrolytic solution 18 is sprayed from both surface sides of the outer leads 34, no variation in plated film thickness occurs between the two surfaces of each outer lead 34.

In addition, since the electrolytic solution supply slits 14*a* and 14*b* and the electrolytic solution drainage slits 15*a* and 15*b* are so formed as to communicate with the same hollow portions 17*a* and 17*b*, the electrolytic solution 18 in the hollow portions 17*a* and 17*b* can flow in contact with the surfaces of the outer leads. More specifically, the electrolytic solution supply slits 14*a* and 14*b* are formed to oppose the proximal end portions of the outer leads and the electrolytic solution drainage slits 15*a* and 15*b* are formed to oppose the distal end portions of the outer leads. This enables the electrolytic solution 18 to flow in contact with almost the entire surface of each outer lead, resulting in high-quality solder plating.

Furthermore, because the electrolytic solution supply slits 14*a* and 14*b* and the electrolytic solution drainage slits 15*a* and 15*b* are formed parallel to each other, the electrolytic solution 18 can flow in substantially uniform contact with the surfaces of the outer leads. This can also realize high-quality solder plating.

Plating was actually performed for the semiconductor product 30 by using the jet plating apparatus of the above embodiment. As a result, a standard deviation $\sigma$ of variations in plated film thickness was 0.6 to 0.8 $\mu$m when the mean film thickness was 10 $\mu$m. Because the standard deviation $\sigma$ of variations in plated film thickness was conventionally 1.0 to 1.5 $\mu$m when the mean film thickness was 10 $\mu$m, the above result demonstrates that the variation was reduced by 20% to 60%.

In addition, according to the jet plating apparatus of the above embodiment, although the number of semiconductor products that can be processed simultaneously is small, the plating unit is decreased in size to decrease the size of the overall plating apparatus, compared to the conventional method in which a whole semiconductor product is dipped in an electrolytic solution. This facilitates a semiconductor device assembly line of an in-line type.

Note that although performing solder plating on the surfaces of outer leads as described above protects the surfaces of the outer leads and facilitates soldering in mounting, increasing the plated film thickness makes mounting to a substrate through thermocompression bonding possible.

Note also that the present invention can be modified and carried out in correspondence with various types of packages of a resin-encapsulated semiconductor device as well as the package of a semiconductor device shown in the above embodiment.

According to the present invention as described above, there can be provided a semiconductor product plating apparatus capable of performing high-quality solder plating for outer leads of resin-encapsulated semiconductor devices on a multiple lead frame within a short time period.

Figure 6:
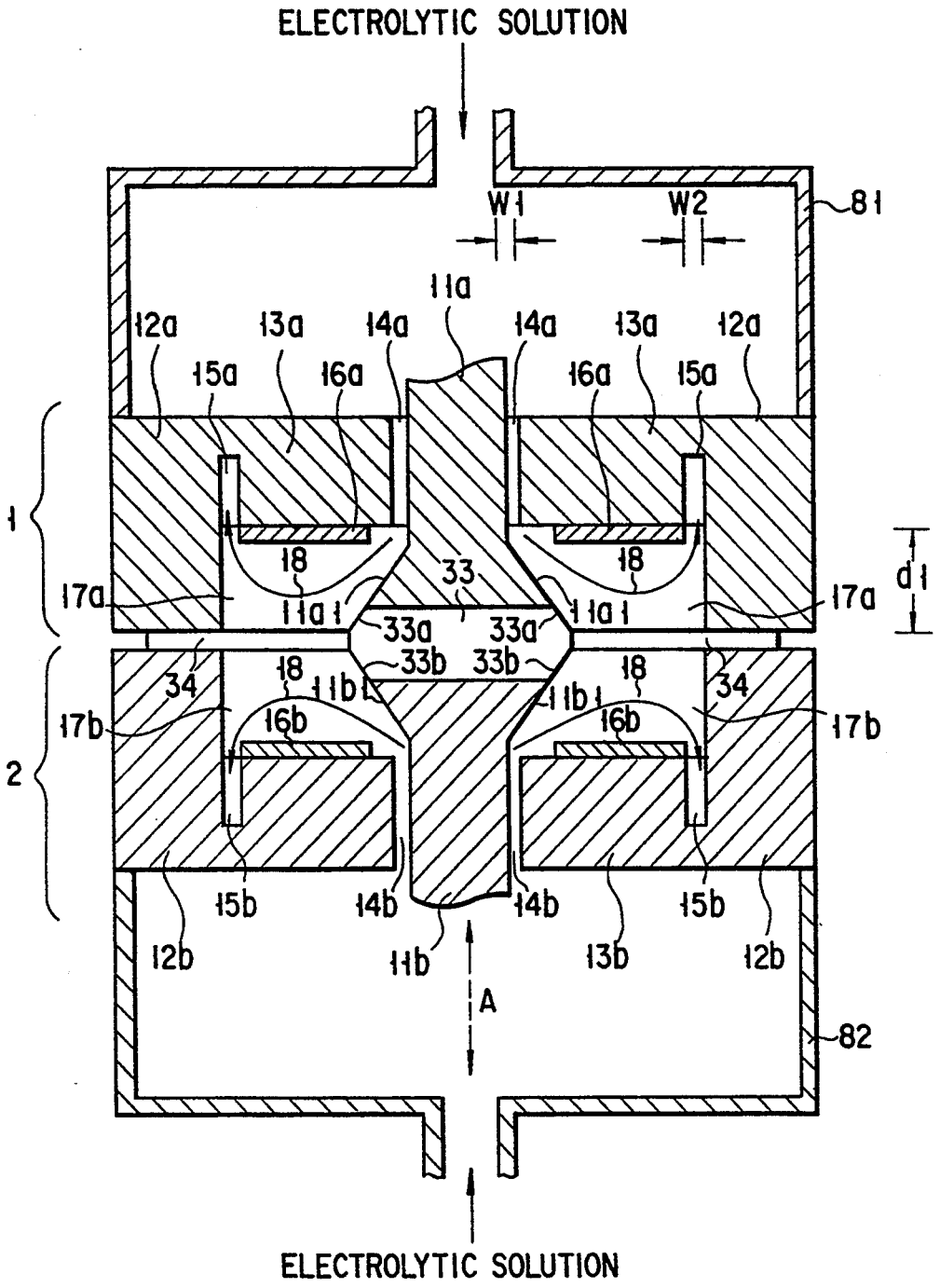
FIG. 6 is a sectional view of a principal part of the jet plating apparatus according to a second embodiment of the present invention.

FIG. 6 is a view schematically showing the arrangement of the second embodiment of the sparger type jet plating apparatus used in the exterior plating step for semiconductor devices.

The same reference numerals as the first embodiment in FIG. 3 denote the same parts in FIG. 6 and a detailed description thereof will be omitted, so only a different portion will be explained below.

Referring to FIG. 6, first and third mask portions 11*a* and 11*b* have tapered side surfaces $\mathbf{11}a_1$ and $\mathbf{11}b_1$ which widen toward the ends. Tapered side surfaces 33*a* and 33*b* of a resin package 33 and the tapered side surfaces $\mathbf{11}a_1$ and $\mathbf{11}b_1$ are so formed as to be located on the same plane when one surface of the resin package 33 is masked. An inclination angle $\theta$ of the tapered side surfaces $\mathbf{11}a_1$ and $\mathbf{11}b_1$ of the first and third mask portions 11*a* and 11*b* is, e.g., nearly 80 degrees.

Electrolytic solution supply slits 14*a* and 14*b* are formed in such a manner as to supply an electrolytic solution toward the proximal end portions of outer leads 34 of a semiconductor device 32 when a semiconductor product 30 is clamped from its both sides by housings 1 and 2. That is, the electrolytic solution supply slits 14*a* and 14*b* are so formed as to extend through housing portions 13*a* and 13*b*. The openings of the slits 14*a* and 14*b* have a length enough to cross the proximal end portions of the outer leads, and an opening width w1 of the slits 14*a* and 14*b* is, e.g., 2 mm.

Electrolytic solution drainage slits 15*a* and 15*b* have opening portions in a direction to cross the distal end portions of the outer leads 34 of the semiconductor device 32 when the semiconductor product 30 is clamped from its both sides by the housings 1 and 2. The electrolytic solution drainage slits 15*a* and 15*b* are formed parallel to the electrolytic solution supply slits 14*a* and 14*b* in the housing portions 13*a* and 13*b*, respectively.

A width w2 of the opening portions of the electrolytic solution drainage slits 15*a* and 15*b* is equal to or smaller than the opening width w1 of the electrolytic solution supply slits 14*a* and 14*b*.

The electrolytic solution drainage slits 15*a* and 15*b* also have a restriction structure in which the width of the opening portion is set smaller than that of the interior of the slit.

In the second embodiment with the above arrangement, the electrolytic solution supply slits 14*a* and 14*b* have the opening portions formed in a direction to cross the proximal end portions of the outer leads 34 of the semiconductor device and communicating with the tapered side surfaces of $\mathbf{11}a_1$ and $\mathbf{11}b_1$ of the first and third mask portions 11*a* and 11*b*. This makes it possible to spray an electrolytic solution 18 toward the proximal end portions of the outer leads 34 along the tapered side surfaces $\mathbf{11}a_1$ and $\mathbf{11}b_1$ of the first and third mask portions 11*a* and 11*b*, allowing the electrolytic solution 18 to flow in uniform contact with the surfaces of the outer leads. As a result, high-quality solder plating can be performed.

In addition, the electrolytic solution supply slits 14*a* and 14*b* oppose the proximal end portions of the outer leads, the electrolytic solution drainage slits 15*a* and 15*b* oppose the distal end portions of the outer leads, and the slits 14*a* and 14*b* and the slits 15*a* and 15*b* are formed parallel to each other. This also enables the electrolytic solution 18 to flow in almost uniform contact with the surfaces of the outer leads, resulting in high-quality solder plating.

Furthermore, since each of the electrolytic solution drainage slits 15*a* and 15*b* has the restriction structure, the electrolytic solution 18 in a hollow portion 17 is prevented from easily flowing into the electrolytic solution drainage slits 15*a* and 15*b*. Consequently, the electrolytic solution 18 can flow in almost uniform contact with the surfaces of the outer leads.

Plating was actually performed for the semiconductor product 30 by using the Jet plating apparatus of the above embodiment. As a result, a standard deviation $\sigma$ of variations in plated film thickness was 0.3 to 0.5 $\mu$m when the mean film thickness was 10 $\mu$m. Because the standard deviation $\sigma$ of variations in plated film thickness was conventionally 1.0 to 1.5 $\mu$m when the mean film thickness was 10 $\mu$m, the above result indicates that the variation was reduced by 50% to 80%.

In addition, according to the jet plating apparatus of the above embodiment, although the number of semiconductor products that can be processed simultaneously is small, the plating unit is decreased in size to decrease the size of the overall plating apparatus, compared to the conventional method in which a whole semiconductor product is dipped in an electrolytic solution. This facilitates a semiconductor device assembly line of an in-line type.

Note that although performing solder plating on the surfaces of outer leads as described above protects the surfaces of the outer leads and facilitates soldering in mounting, increasing the plated film thickness makes mounting to a substrate through thermocompression bonding possible.

Note also that the present invention can be modified and carried out in correspondence with various types of packages of a resin-encapsulated semiconductor device as well as the package of a semiconductor device shown in the above embodiment.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A semiconductor product plating apparatus comprising:

a first housing having a first projecting mask portion for masking a first surface of a resin package of a resin-encapsulated semiconductor device and a second projecting mask portion for masking a first surface of a peripheral portion of a lead frame, electrolytic solution supply slits and electrolytic solution drainage slits being formed in housing portions between said first and second mask portions;

a second housing having a third projecting mask portion for masking a second, opposing surface of said resin package of said resin-encapsulated semiconductor device and a fourth projecting mask portion for masking a second, opposing surface of the peripheral portion of said lead frame, electrolytic solution supply slits and electrolytic solution drainage slits being formed in housing portions between said third and fourth mask portions, and said second housing being formed so as to be movable closer to and further away from said first housing and forming hollow portions surrounding outer leads when moving closer to said first housing to clamp and hold both the surfaces of said resin package of said semiconductor device and those of the peripheral portion of said lead frame together with said first housing;

electrodes formed on inner wall surfaces of said housing portions of said first and second housing;

a power supply unit for applying a positive voltage to said electrodes and a negative voltage to said outer leads between said semiconductor device and the peripheral portion of said lead frame; and an electrolytic solution supply unit for supplying an electrolytic solution to said electrolytic solution supply slits from outside of said first and second housings.

2. An apparatus according to claim 1, wherein said first and third mask portions have tapered side surfaces which widen toward their ends.

3. An apparatus according to claim 2, wherein opening portions of said electrolytic solution supply slits communicate with the side surfaces of said first and third mask portions, respectively.

4. An apparatus according to claim 1, wherein in each of said electrolytic solution drainage slits, a width of an opening portion is smaller than a width of an interior.

5. An apparatus according to claim 2, wherein the tapered side surfaces of said first and third mask portions are so formed as to be located on the same plane as tapered side surfaces of said resin package when said first and second mask portions mask said resin package.

6. An apparatus according to claim 1, wherein each of said electrolytic solution supply slits has an opening portion which communicates with the side surface of said first mask portion so as to supply the electrolytic solution to a position above proximal end portions of said outer leads of said semiconductor device, and each of said electrolytic solution drainage slits has an opening portion which communicates with the side surface of said second mask portion so as to drain the electrolytic solution from a position above distal end portions of said outer leads of said semiconductor device.

7. An apparatus according to claim 1, wherein said electrolytic solution supply slits and said electrolytic solution drainage slits are formed parallel to each other.

8. An apparatus according to claim 1, wherein a width of the opening portions of said electrolytic solution drainage slits is not less than a width of the opening portions of said electrolytic solution supply slits.

* * * * *